US009467763B2

(12) United States Patent
Beal

(10) Patent No.: US 9,467,763 B2
(45) Date of Patent: Oct. 11, 2016

(54) INTEGRATED WIRELESS HEADSET SYSTEM FOR ELECTRONIC DEVICES

(71) Applicant: Jason David Beal, Overland Park, KS (US)

(72) Inventor: Jason David Beal, Overland Park, KS (US)

( * ) Notice: Subject to any disclaimer, the term of this patent is extended or adjusted under 35 U.S.C. 154(b) by 235 days.

(21) Appl. No.: 14/211,770

(22) Filed: Mar. 14, 2014

(65) Prior Publication Data

US 2014/0270234 A1 Sep. 18, 2014

Related U.S. Application Data

(60) Provisional application No. 61/783,198, filed on Mar. 14, 2013.

(51) Int. Cl.
*H04R 1/10* (2006.01)

(52) U.S. Cl.
CPC ..... *H04R 1/1025* (2013.01); *H04R 1/1016* (2013.01); *H04R 2201/025* (2013.01)

(58) Field of Classification Search
None
See application file for complete search history.

(56) References Cited

U.S. PATENT DOCUMENTS

| | | | | |
|---|---|---|---|---|
| 4,432,655 | A | 2/1984 | Wollman | |
| 4,664,533 | A | 5/1987 | Wollman | |
| 5,960,366 | A | 9/1999 | Duwaer | |
| 7,054,659 | B2 | 5/2006 | Gioscia et al. | |
| 7,825,626 | B2 | 11/2010 | Kozisek | |
| 8,095,188 | B2 | 1/2012 | Shi | |
| 8,144,914 | B2 | 3/2012 | Shi | |
| 8,229,515 | B2 | 7/2012 | Griffin et al. | |
| 8,238,967 | B1 | 8/2012 | Arnold et al. | |
| 8,335,456 | B2 | 12/2012 | Kawasaki et al. | |
| 8,336,240 | B2 | 12/2012 | Gray et al. | |
| 8,369,902 | B2 * | 2/2013 | Wang et al. | 455/569.1 |
| 2005/0107131 | A1 | 5/2005 | Abramov | |
| 2007/0042821 | A1 | 2/2007 | Lee et al. | |
| 2007/0202934 | A1 | 8/2007 | Kim | |
| 2009/0069045 | A1 | 3/2009 | Cheng | |
| 2009/0197649 | A1 | 8/2009 | Ranney | |

* cited by examiner

*Primary Examiner* — Muhammad N Edun
(74) *Attorney, Agent, or Firm* — Hovey Williams LLP

(57) ABSTRACT

An integrated wireless electronic system comprises an electronic device, a headset, a charger, and an accessory. The electronic device includes a charger port and a headset port for connecting the charger and the headset to the electronic device. The headset includes a speaker and an earpiece that are retractable into an interior chamber of the headset for inserting the headset into the electronic device. The headset includes a connector end for simultaneously charging the electronic device and the headset with the charger.

21 Claims, 7 Drawing Sheets

INTEGRATED WIRELESS HEADSET SYSTEM FOR ELECTRONIC DEVICES

RELATED APPLICATION

The present application is a non-provisional patent application and claims priority benefit, with regard to all common subject matter, of earlier-filed U.S. provisional patent application titled "Hybrid Watch, Smart Phone and Integrated Bluetooth® Headset Designs for All Bluetooth® Capable Devices", Ser. No. 61/783,198, filed Mar. 14, 2013, incorporated by reference in its entirety into the present document.

BACKGROUND

Bluetooth® is a wireless technology standard for exchanging data over short distances (using short-wavelength ultra high frequency radio waves in the industrial, scientific, and medical band from 2.4 to 2.485 GHz) from fixed and mobile electronic devices. Based upon this technology, the wireless Bluetooth® headset was developed to allow hands-free communication, audio, and other data with users' paired Bluetooth® capable devices. Electronic Bluetooth® capable devices and wireless Bluetooth® headsets are manufactured as discrete devices each with their own power inputs and separate power supplies for maintaining and recharging power. Since wireless headsets are not physically connected with their paired devices and are small in size, they can easily be lost or even damaged. Therefore, users are not able to store the headsets centrally with their pairing devices and are often required to carry or utilize more than one power adapter to maintain power for both.

SUMMARY

The present invention solves the above problems and provides a distinct advance in the art of wireless headsets, such as Bluetooth® technology, so wireless headsets will not have to be stored and charged separately from their paired electronic devices. In particular, the present invention provides integrated wireless headsets that can be compactly docked and centrally stored with an electronic device when not in use and readily removed for use. The invention also allows headsets to be charged with an electronic device via a single charger and input connection or individually via their own separate charging inputs, so users will no longer be required to charge both separately or carry more than one charger.

One embodiment of the invention is an integrated electronic system that broadly comprises an electronic device, a wireless headset, and a single charger. The electronic device may be a mobile or fixed device for communications, Internet connectivity, data transmission, music, gaming and computer related tasks. Examples of mobile devices include, but are not limited to, any wireless communication or audio device, mobile phone, smart phone, watch phone, gaming device, music player; mobile computing platform such as a tablet or laptop computer; car audio or entertainment system; accessory charger; and smart wear or wearable clothing that attaches to a device or charger such as a wrist or watch band. Examples of fixed devices include, but are not limited to, any home or office based device for communication, audio or other wireless headset; desktop computer; smart television or appliance; gaming system; entertainment receiver or sound system; home or office automation system; alarm system; and land line based phone system. One embodiment of the electronic device includes a docking port and a charging port. The docking port includes interior electrical contacts for contacting corresponding electrical contacts of the headset when the headset is in the docking port. Another embodiment of the electronic device does not include a docking port and utilizes the charging port and auxiliary ports for docking the headset. The charging port includes electrical contacts for contacting corresponding electrical contacts of the charger when the device is connected to the charger.

The wireless headset allows the user to listen to audio and to communicate without holding the electronic device up to his or her ear and includes a housing, a speaker, an earpiece, a microphone, a transceiver, a battery, and a set of electrical contacts. In one embodiment, the housing includes outer walls and a cover cooperatively defining an interior chamber. The speaker and the earpiece may be retracted into the interior chamber for safe storing. The cover may then be shifted to enclose the speaker and the earpiece within the interior chamber. The electrical contacts are configured to contact corresponding electrical contacts in the docking port of the electronic device when the headset is in the docking port.

The headset may be stowed in the docking port of the electronic device for protecting the headset and for keeping track of the headset when not in use. The headset battery may also be charged via the electronic device when the headset is stowed in the docking port. The headset battery will charge when the electrical contacts of the headset contact the corresponding electrical contacts in the docking port of the electronic device and when the electrical contacts of the charger contact the corresponding electrical contacts of the charger port of the electronic device. The headset may be retrieved from the docking port and the headset earpiece may be pulled out of the interior chamber when the user desires to listen or communicate via the headset. The headset may also be charged independently of the electronic device through its own charger input.

The charger is connectable to the charging port of the electronic device for charging the electronic device and the headset and includes a power cord for plugging into a wall outlet, a 12-volt outlet, or another power source and electrical contacts for plugging into the charger port. The charger charges the batteries of the headset and the electronic device by delivering power from the power source to the batteries. The power travels from the power source and through the power cord to the battery of the electronic device via its electrical contacts and the corresponding electrical contacts in the charger port of the electronic device. Additional power travels from the electrical contacts in the charger port and through the electrical contacts in the docking station of the electronic device and the corresponding electrical contacts of the headset to the battery of the headset.

Another embodiment of the invention is a headset that can be used with an electronic device that is not equipped with the docking port described above. This embodiment of the headset includes a housing, a speaker, an earpiece, a microphone, a transceiver, a battery, and male and female power input connectors. The headset may also include a stabilizer. The male connector allows the headset to be connected to a charging port of a conventional electronic device, such as a smart phone. The female connector allows a charger to be connected to the headset so that the headset and electronic device can be charged at the same time. The power is routed through the charger to the headset battery and carried through to charge the device battery simultaneously while the headset and the electronic device are connected together.

The stabilizer is inserted into an auxiliary port of the electronic device and reinforces the connection between the headset and the electronic device.

Another embodiment of the invention is a wireless headset that includes left and right audio units. The audio units can be connected to each other when not in use and can be docked and charged via the electronic device or via the headset systems as described above.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
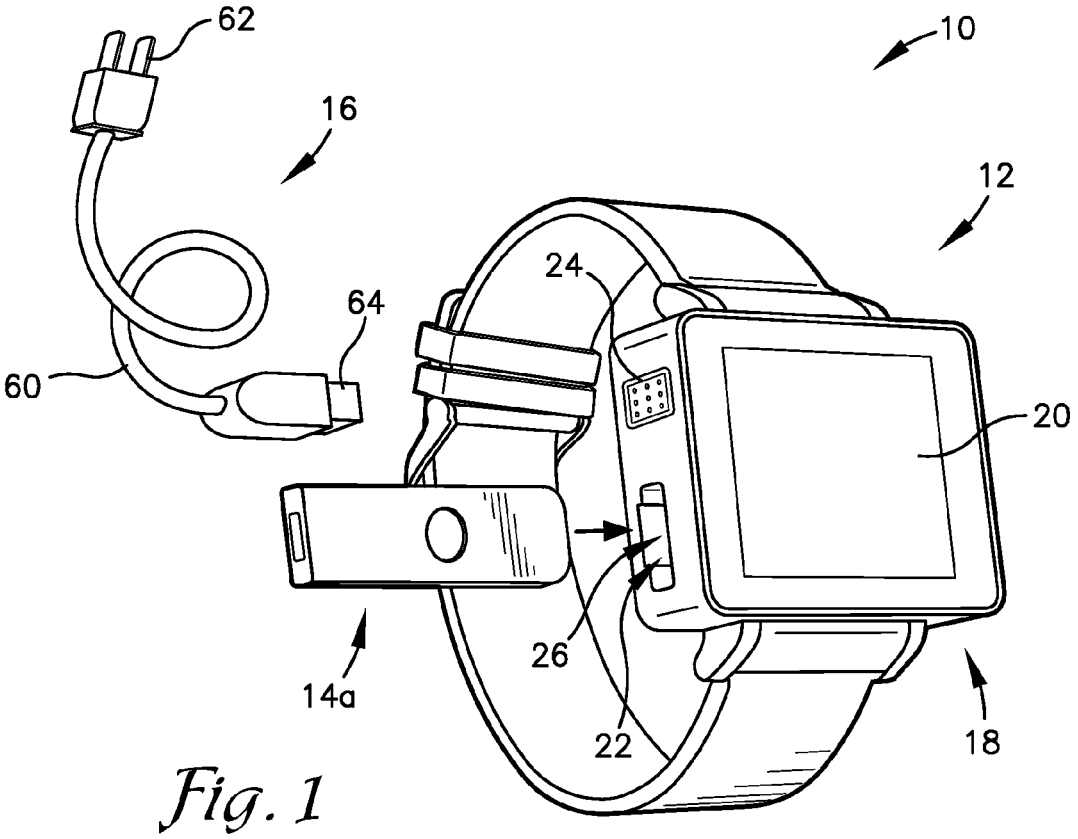
FIG. 1 is a perspective view of an integrated wireless electronic system constructed in accordance with an embodiment of the present invention and shown with a headset being inserted into the docking port of an electronic device.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

One embodiment of the invention is an integrated wireless electronic system 10 illustrated in FIGS. 1-4. The system 10 broadly includes an electronic device 12, a headset 14*a-i*, and a charger 16. The system 10 may also include an accessory such as a cover, a wristband, a stand, or any other additional structure that may include or serve as a docking port for the electronic device 12.

The electronic device 12 is provided for wirelessly communicating with other electronic devices via wireless communication networks, accessing the internet and email, computing, playing music, gaming, timekeeping, or performing any other task performable by an electronic device and may be a smart watch, a smart phone, a tablet, a laptop computer, a video game system, a music player, a personal computer, or any other mobile, portable, or stationary electronic device. Examples of mobile devices include, but are not limited to, any wireless communication or audio device, mobile phone, smart phone, watch phone, gaming device, music player; mobile computing platform such as a tablet or laptop computer; car audio or entertainment system; accessory charger; and smart wear or wearable clothing that attaches to a device or charger such as a wrist or watch band. Examples of fixed devices include, but are not limited to, any home or office based device for communication, audio or other wireless headset; desktop computer; smart television or appliance; gaming system; entertainment receiver or sound system; home or office automation system; alarm system; and land line based phone system.

One embodiment of the electronic device 12 is a smart watch including a housing 18, a display screen 20, a headset docking port 22, a charger port 24, computer circuitry, a battery, and a transceiver, as shown in FIG. 1.

The housing 18 encloses the computer circuitry, the battery, and the transceiver and in this example fits on a user's wrist or forearm.

The display screen 20 displays graphical user interfaces of mobile applications and programs, websites, email, and games and is positioned in the housing 18. The display screen 20 may indicate whether the headset 14*a* and the charger 16 are connected to the electronic device 12 and may indicate a current battery charge of the headset 14*a* and the electronic device 12.

The headset docking port 22 provides a storage location for the headset 14*a* when it is not in use and a charging point for charging the headset 14*a*. The headset docking port 22 includes an open-ended hollow chamber 26 and electrical contacts. The hollow chamber 26 extends into the housing 18 and receives at least a portion of the headset 14*a* therein for protecting the headset 14*a* when the headset 14*a* is stowed in the headset docking port 22 of the electronic device 12. The hollow chamber 26 may open to a front, a side, a top, or a bottom of the housing 18 of the electronic device 12. The electrical contacts are part of a usb, mini usb, micro usb, proprietary connector such as a Lightning or a 30-pin connector, or any other connector for coupling with electrical contacts of the headset 14*a*.

The charger port 24 provides a connection point for connecting the charger 16 to the electronic device 12 and includes electrical contacts for coupling with corresponding electrical contacts of the charger 16. The electrical contacts may be part of a usb, mini usb, micro usb, a proprietary connector such as a Lightning connector, or any other connector. The electrical contacts provide direct power to the electronic device 12 or are electrically coupled with the battery and with the electrical contacts of the headset docking port 22 for delivering power from the charger 16 to the battery of the electronic device 12 and for delivering power to the headset 14*a*.

The computer circuitry implements many of the computer related activities listed above and includes memory and other hardware and software for receiving, storing, accessing, and transmitting information as described below. The computer circuitry may run an operating system such as Android, iOS, Windows or any other computer software system. The computer circuitry may also run conventional web hosting software and communication network connectivity software and protocols such as Bluetooth® technology and near field communication technology for communicating with the headset 14*a* and other electronic devices.

The battery stores power for the electronic device 12 and may be a lithium ion battery or any other rechargeable battery. It will be understood that some devices do not have a battery.

The transceiver transmits wireless signals to and receives wireless signals from the headset 14*a*, other electronic devices, and other communication systems via Bluetooth®, near field, radio frequency, cellular telephone, or other wireless communication protocols or networks.

The accessory may be a wristband, an adaptor, a headband, a clip, a case, another electronic device, a dock, or any other component used with the electronic device 12 to which the headset 14*a* may be connected.

The headset 14*a* provides hands-free listening and communication and includes a housing 28, a speaker 30, an earpiece 32, a microphone 34, an input button 36, a transceiver, a battery, and a set of electrical contacts 38. The headset 14*a* may also include a female charger connector for charging the headset 14*a* separately from the electronic device 12.

Figure 2:
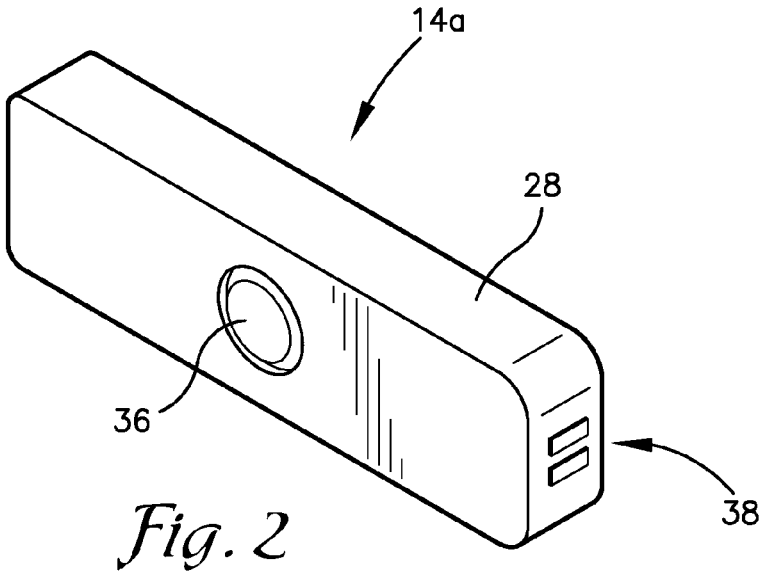
FIG. 2 is an enlarged perspective view of the headset shown in FIG. 1.

The housing 28 provides rigidity and protection to the components of the headset 14*a* and may be made of any suitable material such as metal or plastic. The housing 28 may be rectangular, cylindrical, curved, or any other ergonomical size and shape and includes outer walls and a cover 40, as shown in FIGS. 1-3.

Figure 3:
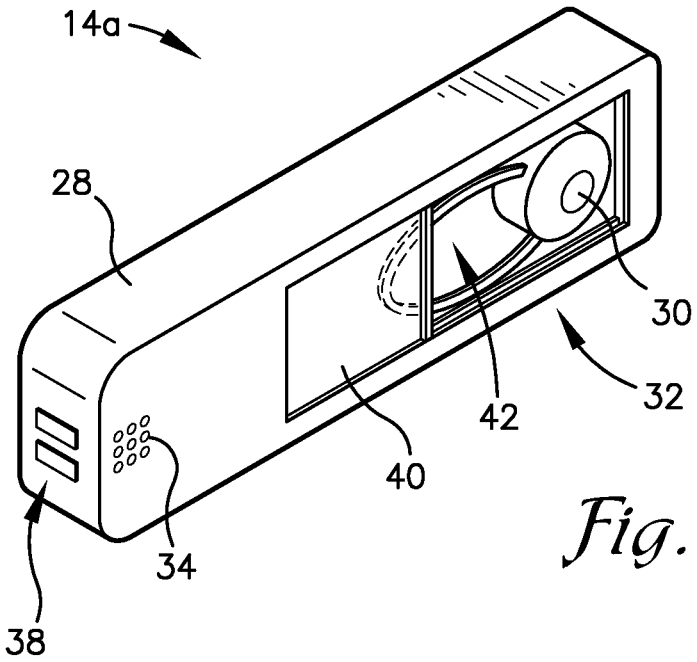
FIG. 3 is an enlarged perspective view of the headset shown in FIG. 1 with the earpiece shifted to a retracted position.
Figure 4:
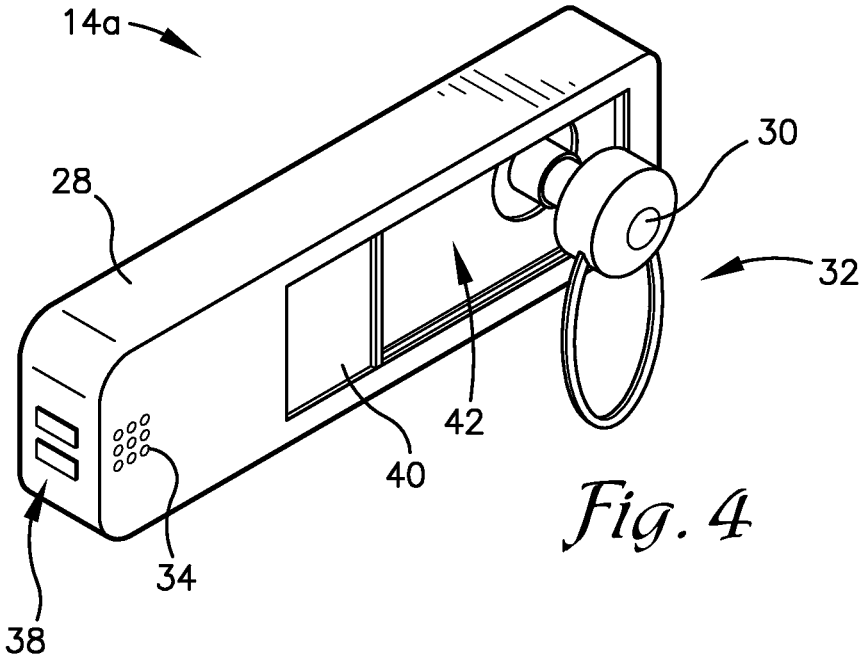
FIG. 4 is an enlarged perspective view of the headset shown in FIG. 1 with the earpiece shifted to an extended position.

The outer walls define an interior chamber 42 configured to house the microphone 34 and the transceiver and to at least partially enclose the speaker 30 and the earpiece 32 when the earpiece 32 is shifted to a retracted position, as shown in FIG. 3.

The cover 40 encloses the speaker 30 and the earpiece 32 in the interior chamber 42 when the earpiece 32 is shifted to the retracted position and is shiftable between an open position (FIG. 3) and a closed position for enclosing the speaker 30 and the earpiece 32 within the interior chamber 42.

The speaker 30 broadcasts audio into the user's ear and faces towards the user's ear when the headset 14*a* is worn.

The earpiece 32 removably retains the headset 14*a* in or on the user's ear and includes an ear bud and a loop, clip, hook, or any other shape for optimum fitting. The ear bud directs the sound from the speaker 30 into the user's ear and the loop fits against ridges in the user's ear for keeping the headset 14*a* from falling off of the user's ear. The earpiece 32 is configured to be shifted to a retracted position within the interior chamber 42 of the housing 28 when not in use (FIG. 3) and pulled and/or twisted to an extended position (FIG. 4) for attaching the earpiece 32 to the user's ear, as described below.

The microphone 34 receives audio spoken by the user and is positioned on an end of the headset 14*a* opposite the speaker 30 and faces the user's mouth or cheek when the headset 14*a* is worn. The microphone 34 may be part of a multiple microphone noise cancellation system.

The input button 36 syncs the headset 14*a* with the electronic device 12 and may be used as an additional user input such as a home button or a power button for the electronic device 12 when the headset 14*a* is connected to the electronic device 12, as shown in FIG. 2.

The transceiver transmits wireless signals to and receives wireless signals from the electronic device 12, other electronic devices, and other communication systems via Bluetooth®, near field, radio frequency, cellular telephone, or other wireless communication protocols or networks.

The battery stores power for the headset 14*a* and may be a lithium ion battery or any other rechargeable battery.

The set of electrical contacts 38 connect to corresponding electrical contacts of the electronic device 12 for charging the headset 14*a*. The electrical contacts 38 may be located on an end, the top, the bottom, or a side of the housing 28. The electrical contacts 38 may also be located on the cover 40 for being retracted into the interior chamber 42 when the cover 40 is shifted to the open position, as shown in FIG. 3.

Alternative headset embodiments, particularly headsets 14*b-i*, include the above described components and one or more connectors described below. The connectors removably couple the headsets 14*b-i* to the electronic device 12 and retain or lock the contact between the electrical contacts 38 of the headset 14*b-i* and the corresponding electrical contacts of the headset docking port 22 of the electronic device 12 when the headset 14*b-i* is coupled to the electronic device 12.

Figure 5:
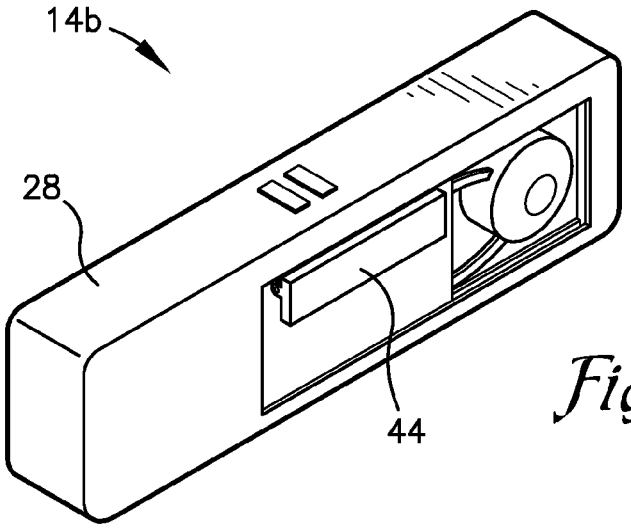
FIG. 5 is an enlarged perspective view of a headset constructed in accordance with another embodiment of the invention.

The headset 14*b* includes an external mount 44 (FIG. 5) configured to be connected with interlocking geometry of the housing 18 of the electronic device 12 or an accessory attached to the electronic device 12. The external mount 44 may be located on the cover 40 for being retracted into the interior chamber 42 when the cover 40 is shifted to the open position and may slide, clip, snap, or lock onto the interlocking geometry of the housing 18 or accessory for retaining the headset 14*b* with the electronic device 12.

Figure 6:
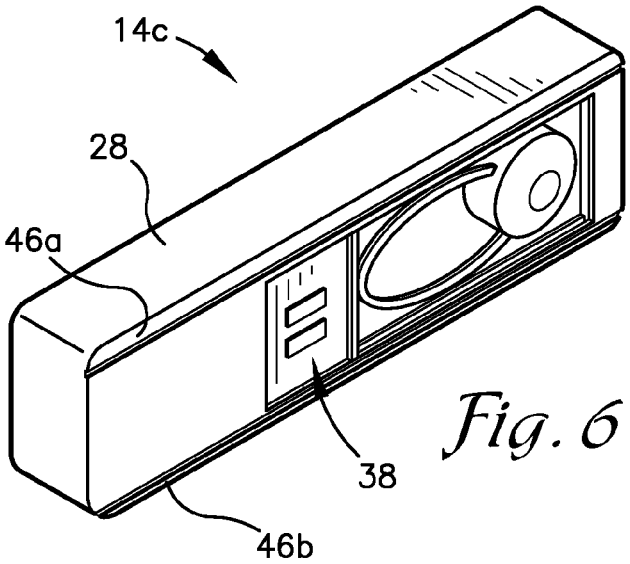
FIG. 6 is an enlarged perspective view of a headset constructed in accordance with another embodiment of the invention.

The headset 14*c* includes ridges, slots, and/or grooves 46*a,b* (FIG. 6) configured to be connected with corresponding ridges or grooves of the housing 18 or accessory for retaining the headset 14*c* with the electronic device 12. The grooves 46*a,b* may be slidably connected to corresponding ridges of the electronic device 12 for ensuring that the headset 14*c* is properly coupled to the electronic device 12.

Figure 7:
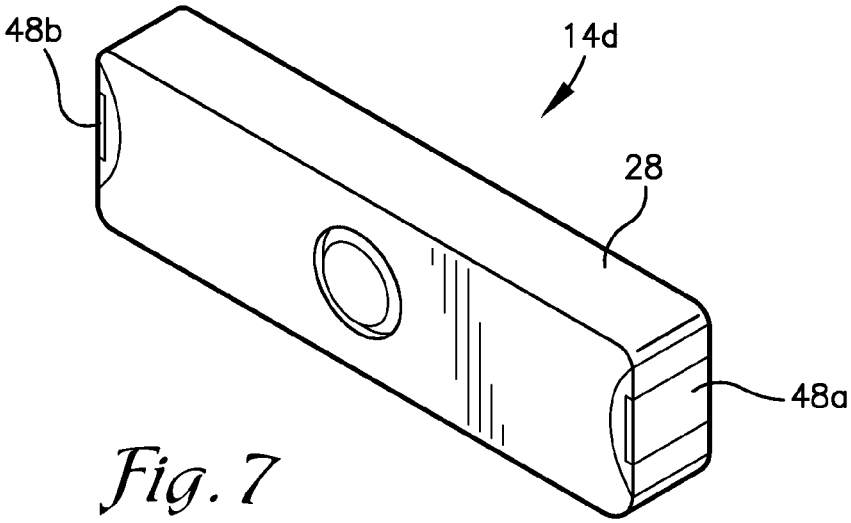
FIG. 7 is an enlarged perspective view of a headset constructed in accordance with another embodiment of the invention.

The headset 14*d* includes resistively bendable tabs 48*a,b* located on opposite ends or sides of the headset 14*d*, as shown in FIG. 7. The resistively bendable tabs 48*a,b* are configured to be pushed inward by corresponding protrusions on the electronic device 12 or accessory of the electronic device until they releasably engage the corresponding protrusions. The user can then release the headset 14*d* from the electronic device 12 by pushing the tabs inward until they clear the corresponding protrusions.

Figure 8:
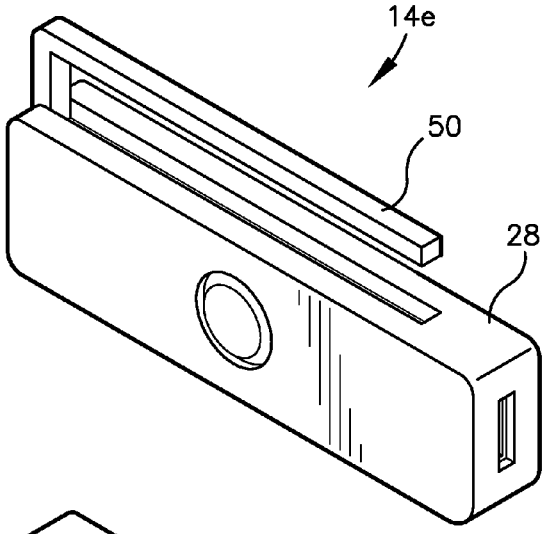
FIG. 8 is an enlarged perspective view of a headset constructed in accordance with another embodiment of the invention.

The headset 14*e* includes an elongated arm 50 that extends from the housing 42 of the headset 14*e*, as shown in FIG. 8. The elongated arm 50 is configured to hook, clip, or hang onto the electronic device 12 or accessory of the electronic device 12 and may be reversibly retracted into the interior chamber 42 when not in use.

Figure 9:
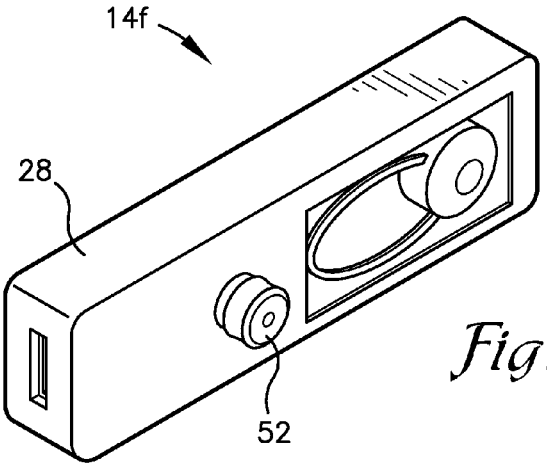
FIG. 9 is an enlarged perspective view of a headset constructed in accordance with another embodiment of the invention.

The headset 14*f* includes a snap protrusion 52 (FIG. 9) that can be inserted into a snap recess of the electronic device 12, accessory of the electronic device 12, or vice versa for resistively retaining the headset 14*f* on the electronic device 12 or accessory of the electronic device 12. The snap is dislodged from the snap recess by pulling the headset 14*f* from the electronic device 12 or accessory of the electronic device 12 with a small amount of force.

Figure 10:
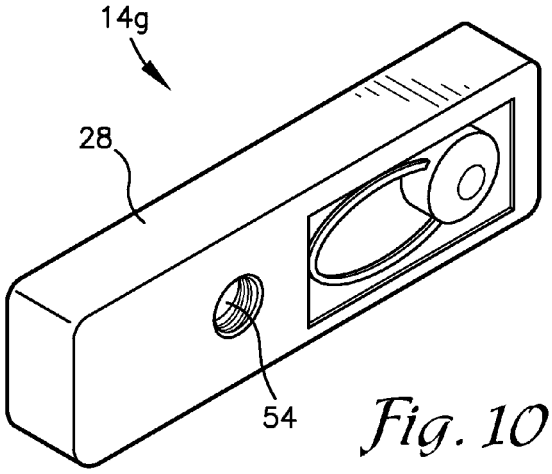
FIG. 10 is an enlarged perspective view of a headset constructed in accordance with another embodiment of the invention.

The headset 14*g* includes a threaded recess 54 (FIG. 10) that can receive a threaded protrusion of the electronic device 12 for tightening the headset 14*g* onto the electronic device 12 or accessory of the electronic device 12.

Figure 11:
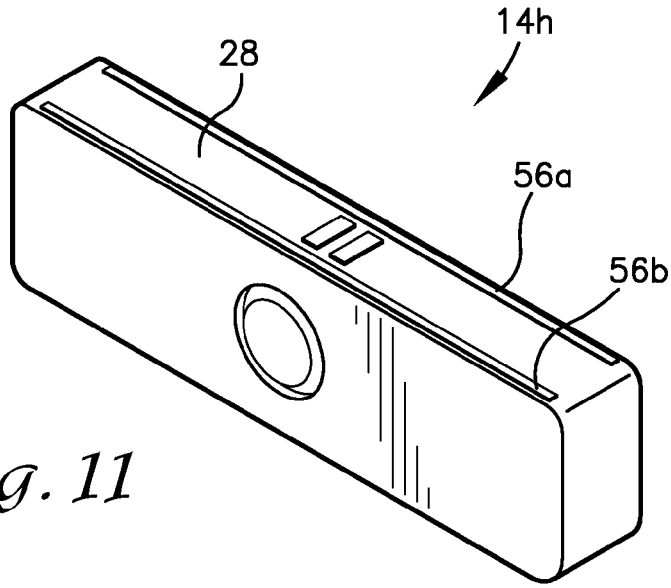
FIG. 11 is an enlarged perspective view of a headset constructed in accordance with another embodiment of the invention.

The headset 14*h* includes magnet strips 56*a,b* (FIG. 11) that can be magnetically attached to corresponding magnets or a ferromagnetic surface on the electronic device 12 or accessory of the electronic device 12. The magnet strips 56*a,b* are separated from the corresponding magnets of the electronic device 12 or accessory of the electronic device 12 by pulling the headset 14*h* from the electronic device 12 or accessory of the electronic device 12 with a small amount of force.

The headset 14*i* includes a hook and loop fastener 58 (FIG. 12) that can be pressed against a corresponding hook and loop fastener of the electronic device 12 or accessory of the electronic device 12 such that hooks of one fastener catch on loops of the other fastener. The hook and loop fasteners are separated by pulling the headset 14*i* from the electronic device 12 or accessory of the electronic device 12 with a small amount of force. The headset 14*i* could instead include an adhesive for connecting the headset 14*i* to the electronic device 12 or accessory of the electronic device 12.

The charger 16 delivers power to the electronic device 12 and/or the headset 14*a* when connected to the electronic device 12 and includes a power cord 60, a first set of electrical contacts 62, and a second set of electrical contacts 64, as shown in FIG. 1. The power cord 60 is provided for connecting the charger 16 between a power supply such as a power outlet or another electronic device and the electronic device 12 and the headset 14*a*. The first set of electrical contacts 62 may be part of a conventional wall plug, a usb, mini, or micro usb connector, a 12-volt connector, a proprietary connector such as a Lightning connector, or any other connector. The second set of electrical contacts 64 may be part of a usb, mini usb, or micro usb connector or a proprietary connector such as a Lightning or 30-pin connector, or any other connector.

Using the integrated wireless electronic system 10 and simultaneously charging the headset 14*a* and the electronic device 12 via the electronic device 12 will now be described in more detail.

Figure 12:
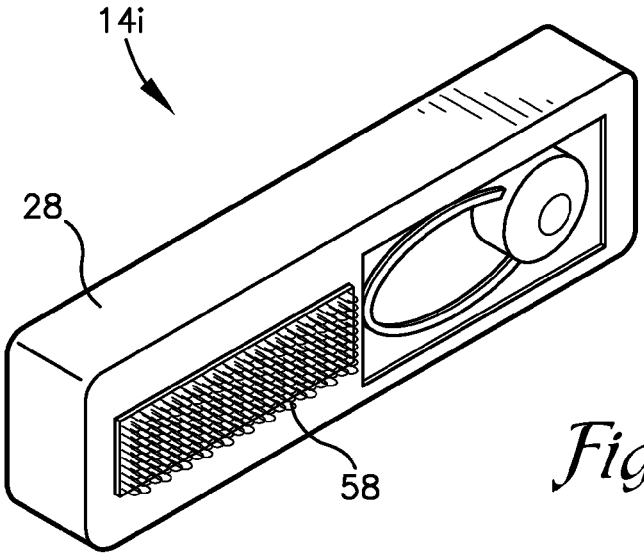
FIG. 12 is an enlarged perspective view of a headset constructed in accordance with another embodiment of the invention.

The user may prepare the headset 14*a* for being worn by sliding, pivoting, or rotating the cover 40 to an open position, pulling the speaker 30 and/or the earpiece 32 out of the interior chamber 42 and/or twisting the earpiece 32 away from the housing 28 of the headset 14*a* to an extended position (FIG. 12). The user may then place or clip the earpiece 32 onto his or her ear or insert the earpiece 32 into his or her ear. The user may then turn the headset 14*a* on and/or sync the headset 14*a* with the electronic device 12 by pressing the input button 36 on the headset 14*a*. The headset 14*a* will then establish a wireless connection with the electronic device 12. The user may then talk into the microphone 34 and the transceiver of the headset 14*a* will transmit a signal representative of the user's voice to the electronic device 12. The transceiver will also receive signals representative of another person's voice, other audio or data, and the speaker 30 will broadcast the audio into the user's ear.

The batteries of the headset 14*a* and the electronic device 12 will need to be recharged periodically and may be charged simultaneously via the charger 16. The user may prepare the headset 14*a* for charging by removing the headset 14*a* from his or her ear, pushing and/or twisting the earpiece 32 towards the housing 28 of the headset 14*a*, pushing the speaker 30 and/or the earpiece 32 into a retracted position within the interior chamber 42, and shifting the cover 40 to the closed position so that the speaker 30 and the earpiece 32 are protected and compactly stored. In some embodiments of the headset 14*a*, shifting the cover 40 to the closed position exposes the electrical contacts 38 for connecting the headset 14*a* to the electronic device 12. The user then inserts the headset 14*a* into the hollow chamber 26 of the headset docking port 22 of the electronic device 12 so that at least a portion of the headset 14*a* is enclosed by the housing 18 of the electronic device 12. In some embodiments of the headset docking port 22, the headset 14*a* is completely received in the hollow chamber 26 of the headset docking port 22 when the headset 14*a* is docked. The electrical contacts 38 of the headset 14*a* will contact the corresponding electrical contacts of the headset docking port 22 of the electronic device 12 when the headset 14*a* is inserted into the headset docking port 22. The display screen 20 may indicate whether the headset 14*a* is properly connected to the electronic device 12. The headset 14*a* may also charge independently via a female power input if needed.

The user may then plug the first end of the charger 16 into a wall outlet or other power source and the second end of the charger 16 into the charger port 24 of the electronic device 12 so that the second set of contacts 64 of the charger 16 contact the corresponding contacts of the charger port 24 of the electronic device 12. The charger 16 will then simultaneously charge the batteries of the electronic device 12 and the headset 14*a* or directly power the electronic device 12 and the headset 14*a*. The display screen 20 may indicate whether the charger 16 is charging the headset 14*a* and the electronic device 12. When the headset battery is fully charged or when the user desires to use the headset 14*a* again, the user may remove the headset 14*a* from the hollow chamber 26 of the headset docking port 22 and may prepare the headset 14*a* for being worn as described above.

Using the alternative headsets 14*b*-11*s* substantially similar to using the headset 14*a* as described above except the user connects the connector of the headset 14*b-i* to the corresponding connector of the electronic device 12 or accessory when connecting the headset 14*b-i* to the electronic device 12. The user removes the headset 14*b-i* from the electronic device 12 by disconnecting the connector of the headset 14*b-i* from the corresponding connector of the electronic device 12 or accessory of the electronic device 12. For example, the grooves 46*a,b* of the headset 14*c* are aligned with and slid along corresponding ridges of the electronic device 12 to ensure that the headset 14 is properly docked with the electronic device 12. The resistively bendable tabs 48*a,b* of the headset 14*d* may be releasibly engaged by corresponding protrusions of the electronic device 12. The user may hook the elongated arm 50 of the headset 14*e* onto a corresponding loop of the electronic device 12 and disconnect the elongated arm 50 from the loop and push the elongated arm 50 into the interior chamber 42 of the headset 14*e* for wearing the headset 14*e*.

The integrated wireless electronic system 10 provides many advantages over conventional wireless electronic systems. For example, the headset docking port 22 of the electronic device 12 partially or completely encloses the headset 14*a* in its hollow chamber 26 when the headset 14*a* is docked with the electronic device 12 or accessory of the electronic device 12. This provides protection to the headset 14*a* and compactly stores the headset 14*a* with the electronic device 12 when not in use. The headset 14*a* compactly stores and protects the speaker 30 and the earpiece 32 in the interior chamber 42 of the headset 14*a* when they are shifted to a retracted position and when the cover 40 is shifted to a closed position. The input button 36 can also be used as a home button, a power button, or any other additional input for the electronic device 12 when the headset 14*a* is connected to the electronic device 12 or accessory. In addition, the connectors of the headsets 14*b-i* retain the contact between the headsets 14*b-i* and the device 12 and prevent the headsets 14*b-i* from becoming accidentally disconnected from the electronic device 12. The integrated wireless electronic system 10 allows both devices to charge simultaneously via a single charger.

Figure 13:
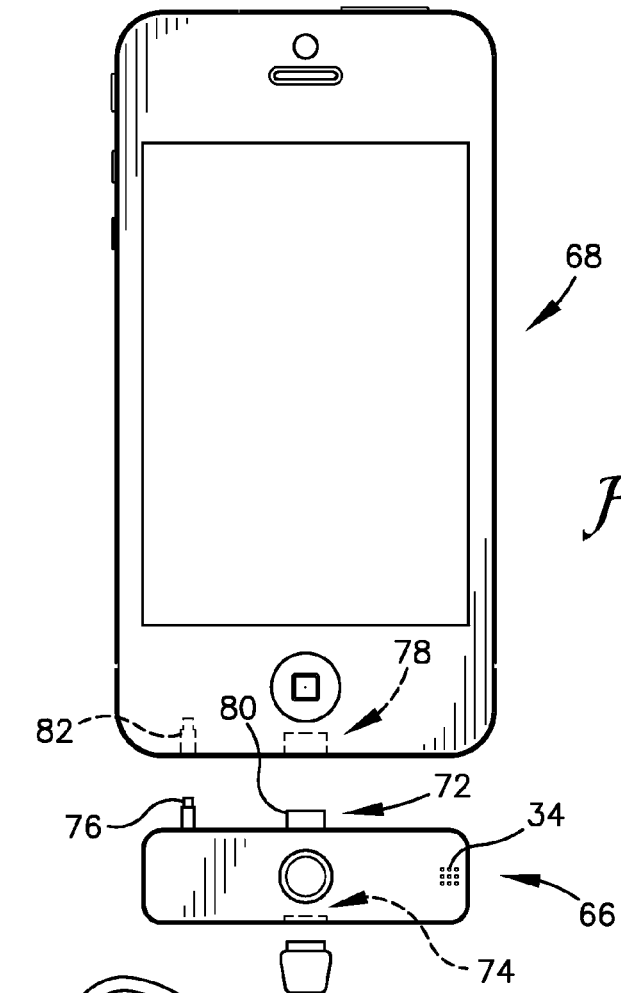
FIG. 13 is a schematic diagram of another embodiment of the invention in which a headset is configured for use with a conventional smart phone.
Figure 14:
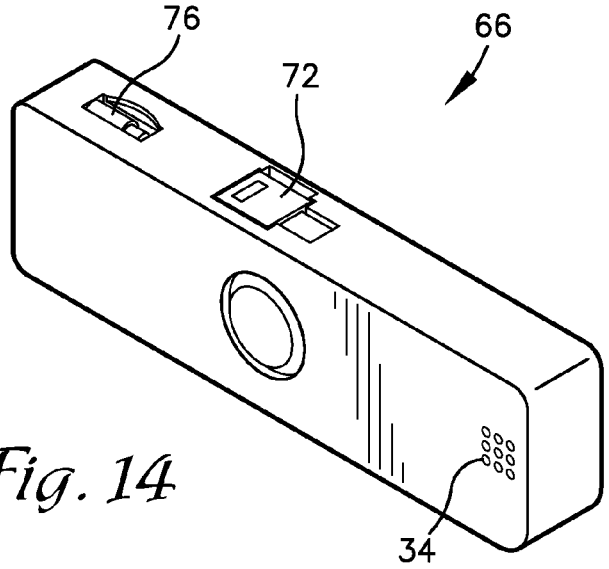
FIG. 14 is an enlarged perspective view of the headset of FIG. 13 with the first connector and the stabilizer of the headset shifted to a retracted position.
Figure 15:
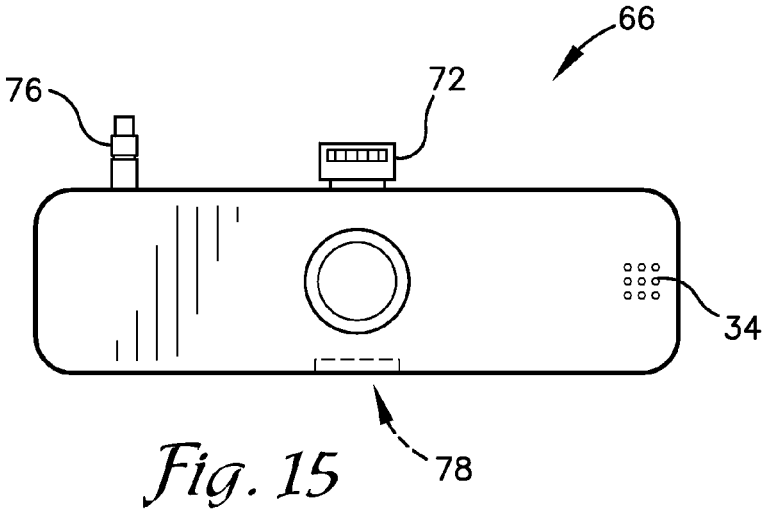
FIG. 15 is an elevation view of the headset of FIG. 13 shown with the first connector and the stabilizer of the headset shifted to an extended position.

A headset 66 constructed in accordance with another embodiment of the invention is illustrated in FIGS. 13-15. This headset 66 is designed for use with a conventional electronic device 68 and for simultaneously charging the headset 66 and the electronic device 68 via a single charger 70. The headset 66 comprises a housing, a speaker, an earpiece, one or more microphones, an input button, a transceiver, and a battery as described above, and first and second connectors 72, 74 and a stabilizer 76.

The first connector 72 connects the headset 66 to a charging port 78 of a conventional electronic device 68 and includes electrical contacts 80 for connecting to corresponding electrical contacts of the charging port 78. The electrical contacts may be part of a male or female usb, mini usb, micro usb, proprietary connector such as a Lightning or a 30-pin connector, or any other connector. The first connector 72 may be pivoted or slideably shifted to a retracted position within or against the housing of the headset 66 when not in use, as shown in FIG. 14.

The second connector 74 connects the headset 66 to a charger 70 and includes electrical contacts for connecting to corresponding electrical contacts of the charger 70. The electrical contacts may be part of a male or female usb, mini usb, micro usb, proprietary connector such as a Lightning or a 30-pin connector, or any other connector.

The stabilizer 76 stabilizes the headset 66 with the electronic device 68 and is configured to be inserted into an auxiliary port 82 of the electronic device 68. The stabilizer 76 may be a 3.5 millimeter pin or any other connector and may be pivoted or slideably shifted to a retracted position within or against the housing of the headset 66 when not in use, as shown in FIG. 14.

Using the headset 66 with the electronic device 68 and simultaneously charging the headset 66 and the electronic device 68 via the headset 66 will now be described in more detail.

The user may prepare the headset 66 for being worn by disconnecting the headset 66 from the electronic device 68 and pivoting or sliding the first connector 72 and the stabilizer 76 to retracted positions within or against the housing of the headset 66 (FIG. 14). The user may then extend the earpiece, clip the earpiece to his or her ear, turn the headset 66 on, sync the headset 66 with the electronic device 68, and use the headset 66 as described above.

The batteries of the headset 66 and mobile electronic devices such as the electronic device 68 will need to be recharged periodically and may be charged simultaneously with the charger 70. The user may prepare the headset 66 for charging by removing the headset 66 from his or her ear and shifting the earpiece to the retracted position, as described above, and by pivoting or sliding the first connector 72 and the stabilizer 76 to extended positions, as shown in FIG. 15. The user may then connect the headset 66 to the charging port 78 of the electronic device 68 such that the electrical contacts 80 of the first connector 72 of the headset 66 contact the corresponding electrical contacts of the charging port 78 of the electronic device 68 and such that the stabilizer 76 is inserted into the auxiliary port 82 of the electronic device 68. The display screen of the electronic device 68 may indicate whether the headset 66 is properly connected to the electronic device 68.

The user may then plug the first end of the charger 70 into a wall outlet or other power source and the second end of the charger 70 into the second connector 74 of the headset 66. The charger 70 will then simultaneously charge the batteries of the headset 66 and the electronic device 68. The display screen of the electronic device 68 may indicate that the batteries are charging. The user can also charge the headset 66 and the electronic device 68 separately by connecting the second end of the charger 70 to the second connector 74 of the headset 66 or to the charging port 78 of the electronic device 68 without connecting the headset 66 to the electronic device 68. When the headset battery and/or the electronic device battery are fully charged or when the user desires to use the headset 66 again, the user may disconnect the headset 66 from the charging port 78 of the electronic device 68 and may prepare the headset 66 for being worn as described above. The headset 66 may also be charge via direct power when the first connector 72 is connected to a charging port of a fixed electronic device.

The headset 66 provides many advantages over conventional wireless headsets. For example, the headset 66 can be connected to the charging port 78 of a conventional electronic device 68 and the charger 70 can be connected to the headset 66, which allows the headset 66 and the conventional electronic device 68 to be charged simultaneously via a single charger. In addition, the stabilizer 76 of the headset 66 can be inserted into a corresponding connector of the electronic device 68, which reinforces the connection between the headset 66 and the electronic device 68.

Figure 16:
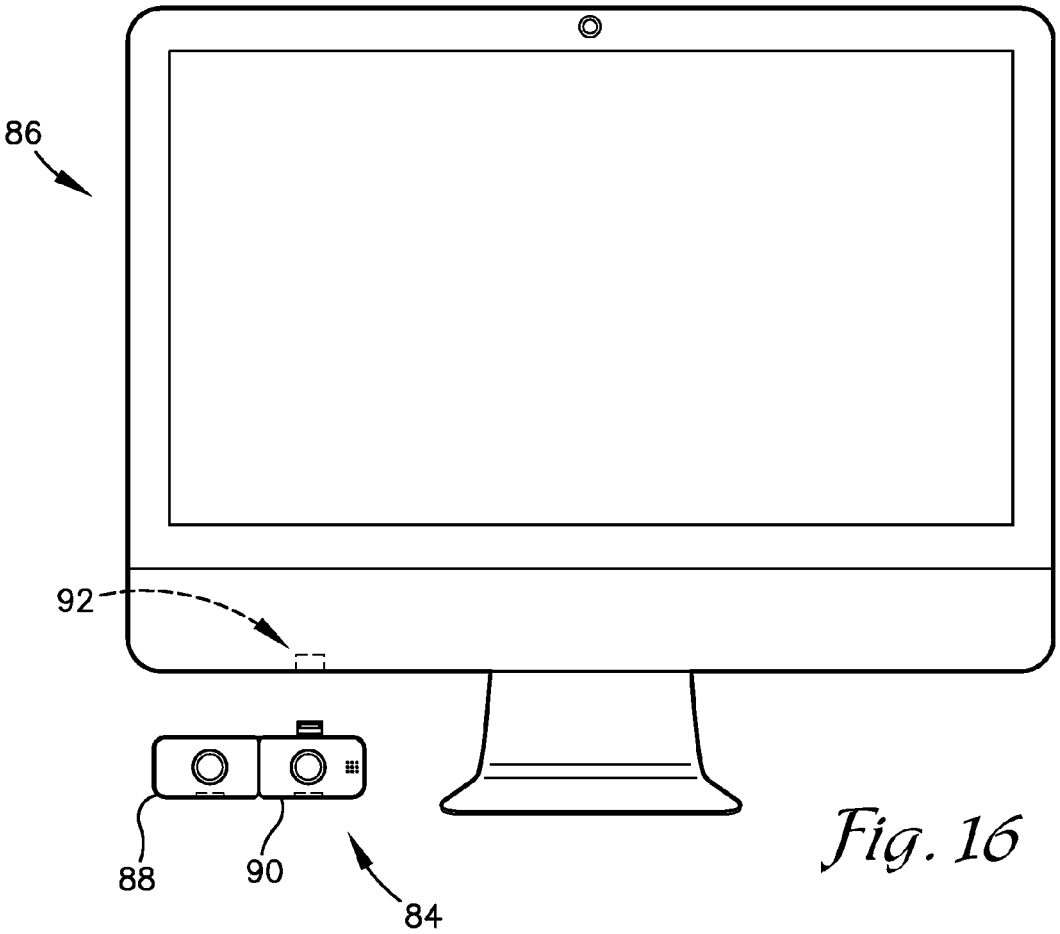
FIG. 16 is a schematic diagram of another embodiment of the invention in which a dual earpiece headset system is configured for use with a desktop computer.

A headset 84 constructed in accordance with another embodiment of the invention is illustrated in FIG. 16. This headset 84 is designed for use with an electronic device 86 and comprises left and right audio units 88, 90.

The left and right audio units 88, 90 broadcast mono audio or stereo audio into the left and right ears of the user. One or both of the audio units 88, 90 include a housing, a speaker, an earpiece, a transceiver, female power input, a microphone, a home button, and a battery as described above. One or both of the left and right audio units 88, 90 also each include a set of electrical contacts for connecting the audio units 88, 90 to the charging port 92 of the electronic device 86. The left and right audio units 88, 90 may include an additional set of electrical contacts for connecting the audio units 88, 90 together with either the left audio unit 88 or the right audio unit 90 including electrical contacts for connecting to the charging port 92 of the electronic device 86. The left and right audio units 88, 90 may include a wire configured to connect them together.

Using the headset 84 with the electronic device 86 and charging the headset 84 will now be described in more detail.

The user may prepare the headset 84 for use by disconnecting the headset 84 from the charging port 92 of the electronic device 86 and separating the left and right audio units 88, 90 from each other. The user may then extend the earpieces of the left and right audio units 88, 90, clip or insert the earpieces or earbuds into his or her left and right ears, turn the headset 84 on, sync the headset 84 with the electronic device 86, and use the headset 66 as described above.

The battery of the headset 84 will need to be recharged periodically. The user may prepare the headset 84 for charging by removing the left and right audio units 88, 90 from his or her ear and shifting the earpieces to retracted positions, as described above. The user may then connect the left and right audio units 88, 90 together via their corresponding electrical contacts and then connect the headset 84 to the charging port 92 of the electronic device 86. When the batteries of the left and right audio units 88, 90 are fully charged or when the user desires to use the headset 84 again, the user may disconnect the left and right audio units 88, 90 from the charging port 92 of the electronic device 86, disconnect the left and right audio units 88, 90 from each other, and then prepare the headset 84 for being worn as described above. The headset 84 can also charge from the electronic device through its female power port.

The headset 84 provides many advantages over conventional headsets. For example, the left and right audio units 88, 90 may be connected together when being charged and when not in use, which prevents them from becoming lost. In addition, the left and right audio units 88, 90 may be charged simultaneously via a conventional electronic device 86. The left and right audio units 88, 90 may also be used and/or charged independently.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

Having thus described various embodiments of the invention, what is claimed as new and desired to be protected by Letters Patent includes the following:

1. A wireless headset for use with an electronic device, the headset comprising:

a housing including outer walls defining an interior chamber;

a speaker attached to the housing for broadcasting audio into the ear of a user;

an earpiece attached to the housing, the earpiece being configured to be inserted into the ear of the user for directing the audio from the speaker into the ear of the user when the headset is worn and being configured to be retained within the interior chamber when shifted to a retracted position;

a cover configured to be shifted to a closed position over the interior chamber such that the cover encloses the earpiece in the interior chamber and configured to be shifted to an open position such that the earpiece may be extended from the interior chamber;

a microphone positioned within the housing for receiving audio spoken by the user;

a transceiver positioned within the housing for receiving wireless signals from the electronic device and for transmitting wireless signals to the electronic device; and a battery positioned within the housing for supplying power to the headset, the battery of the headset being configured to be charged via the electronic device such that the headset and the electronic device are charged simultaneously.

2. The headset of claim 1, wherein the headset further comprises a connector configured to removably attach the headset to the electronic device.

3. The headset of claim 1, wherein the headset further comprises electrical contacts configured to contact electrical contacts of the electronic device for charging the headset, the electrical contacts of the headset being located on the cover and concealed within the interior chamber of the headset when the cover is shifted to the open position for protecting the electrical contacts when the headset is worn.

4. The headset of claim 1, wherein the headset further comprises an input button configured to sync the headset and the electronic device.

5. The headset of claim 1, wherein the headset further comprises electrical contacts configured to contact electrical contacts of the electronic device for charging the headset.

6. A headset for use with an electronic device, the headset comprising:

a housing;

a speaker attached to the housing for broadcasting audio into the ear of a user;

an earpiece attached to the housing and configured to be inserted into the ear of the user for directing the audio from the speaker into the ear of the user when the headset is worn;

a microphone positioned within the housing for receiving audio spoken by the user;

a transceiver positioned within the housing for receiving wireless signals from a electronic device and for transmitting wireless signals to the electronic device;

a battery positioned within the housing for providing power to the headset;

a first set of electrical contacts configured to contact electrical contacts of the electronic device; and a second set of electrical contacts configured to contact electrical contacts of a charger, the headset being configured to receive a charging current from the charger via the first set of electrical contacts and being configured to send a charging current to the electronic device via the second set of electrical contacts for simultaneously charging the battery of the headset and a battery of the electronic device when the headset is removably connected to the electronic device and the charger.

7. The headset of claim 6, wherein the first set of electrical contacts comprise male geometry for mating with female geometry of the electronic device and the second set of electrical contacts comprise female geometry for mating with male geometry of the charger.

8. The headset of claim 6, further comprising a connector for removably attaching the headset to the electronic device.

9. The headset of claim 8, wherein the connector includes a groove for slideably interconnecting with a ridge of the electronic device.

10. The headset of claim 8, wherein the connector includes a resistively bendable tab configured to be releasably retained by a protrusion of the electronic device for removably attaching the headset to the electronic device.

11. The headset of claim 10, wherein the connector includes an elongated arm configured to hook into a corresponding structure of the electronic device for removably attaching the headset to the electronic device.

12. The headset of claim 11, wherein the elongated arm is configured to be reversibly retracted into the housing of the headset when the headset is not attached to the electronic device.

13. The headset of claim 8, wherein the connector includes a snap protrusion configured to be resistively inserted into a snap recess of the electronic device for removably attaching the headset to the electronic device.

14. The headset of claim 8, wherein the connector includes a threaded recess configured to receive a threaded protrusion of the electronic device for removably attaching the headset to the electronic device.

15. The headset of claim 8, wherein the connector includes an adhesive fastener configured to removably connect the headset to the electronic device.

16. The wireless headset of claim 6, wherein the housing is comprised of a left audio unit, and the wireless headset further comprises an additional housing comprised of a right audio unit, the left and right audio units being configured to be removably connected to each other for charging the headset and being configured to be charged independently of each other.

17. The wireless headset of claim 6, further comprising a stabilizer for stabilizing the headset with the electronic device.

18. The wireless headset of claim 6, wherein the electronic device is a fixed device receiving direct power and wherein the battery of the headset is configured to be charged when the first set of electronic contacts of the headset are connected to the electrical contacts of the electronic device.

19. A headset for use with an electronic device, the headset comprising:

a housing;

a speaker attached to the housing for broadcasting audio into the ear of a user;

an earpiece attached to the housing and configured to be inserted into the ear of the user for directing the audio from the speaker into the ear of the user when the headset is worn;

a microphone positioned within the housing for receiving audio spoken by the user;

a transceiver positioned within the housing for receiving wireless signals from a electronic device and for transmitting wireless signals to the electronic device;

a battery positioned within the housing for providing power to the headset;

a male connector including a first set of electrical contacts configured to contact electrical contacts of the electronic device, the male connector being configured to be shifted to a retracted position when not connected to the electronic device; and a female connector including a second set of electrical contacts configured to contact electrical contacts of a charger;

the headset being configured to receive a charging current from the charger via the first set of electrical contacts and configured to send a charging current to the electronic device via the second set of electrical contacts for simultaneously charging the battery of the headset and a battery of the electronic device when the headset is removably connected to the electronic device and the charger.

20. A wireless headset for use with an electronic device, the headset comprising:

a left audio unit comprising:

a left housing;

a left speaker attached to the left housing; and a left earpiece attached to the left housing;

a right audio unit comprising:

a right housing;

a right speaker attached to the right housing; and a right earpiece attached to the right housing;

a microphone for receiving audio spoken by the user;

a transceiver for receiving wireless signals from the mobile electronic device for transmitting wireless signals to the mobile electronic device; and a battery for supplying power to the headset, the battery of the headset being configured to be charged via the electronic device such that the headset and the electronic device are charged simultaneously.

21. A headset for use with an electronic device, the headset comprising:

a housing;

a speaker attached to the housing for broadcasting audio into the ear of a user;

an earpiece attached to the housing and configured to be inserted into the ear of the user for directing the audio from the speaker into the ear of the user when the headset is worn;

a microphone positioned within the housing for receiving audio spoken by the user;

a transceiver positioned within the housing for receiving wireless signals from an electronic device and for transmitting wireless signals to the electronic device; and a battery positioned within the housing for providing power to the headset, the battery of the headset being configured to be charged via the charger while the electronic device is charging via the headset such that the headset and the electronic device are charged simultaneously.

* * * * *